US005816204A

United States Patent [19]

Moriya et al.

[11] Patent Number: 5,816,204

[45] Date of Patent: Oct. 6, 1998

[54] VARIABLE VALVE TIMING MECHANISM FOR INTERNAL COMBUSTION ENGINE

[75] Inventors: Yoshihito Moriya, Nagoya; Kiyoshi Sugimoto, Okazaki; Tadao Hasegawa, Toyota, all of Japan

[73] Assignee: Toyota Jidosha Kabushiki Kaisha, Toyota, Japan

[21] Appl. No.: 980,353

[22] Filed: Nov. 28, 1997

[51] Int. Cl.[6] ..... F01L 1/344

[52] U.S. Cl. ..... 123/90.17; 123/90.31

[58] Field of Search ..... 123/90.15, 90.17, 123/90.31; 74/567, 568 R; 461/1, 2, 160

[56] References Cited

U.S. PATENT DOCUMENTS

| | | | |
|---|---|---|---|
| 4,858,572 | 8/1989 | Shirai et al. | 123/90.12 |
| 5,450,825 | 9/1995 | Geyer et al. | 123/90.17 |
| 5,666,914 | 9/1997 | Ushida et al. | 123/90.17 |
| 5,724,929 | 3/1998 | Mikame et al. | 123/90.17 |

FOREIGN PATENT DOCUMENTS

| | | |
|---|---|---|
| 799977A1 | 10/1997 | European Pat. Off. . |
| 806550 | 11/1997 | European Pat. Off. . |
| 19623818 | 12/1996 | Germany . |
| 1-092504 | 4/1989 | Japan . |
| 2-050105 | 4/1990 | Japan . |
| 8-121123 | 5/1996 | Japan . |
| 9-060508 | 3/1997 | Japan . |

*Primary Examiner*—Weilun Lo
*Attorney, Agent, or Firm*—Cushman Darby & Cushman IP Group of Pillsbury Madison & Sutro LLP

[57] ABSTRACT

A variable valve timing mechanism of an internal combustion engine varies the rotational phase of a camshaft with respect to a drive shaft to vary the timing of a set of engine valves. The mechanism includes a first rotor for a rotation in synchronism with the drive shaft and a second rotor for a rotation in synchronism with the camshaft. The second rotor has vanes, which are located in hydraulic chambers. Unequal hydraulic forces on the vanes causes the second rotor to rotate with respect to the first rotor to change the rotational phase of the camshaft with respect to the drive shaft. Hydraulic pressure is supplied to a certain side of the vanes to apply forces to the vanes. A lock member locks the second rotor to the first rotor to fix the rotational phase of the camshaft with respect to the drive shaft. The lock member unlocks the second rotor from the first rotor only when the hydraulic pressure supplied to the vanes is such that the torque produced by the hydraulic pressure on the vanes is at least as great as an oppositely directed torque resulting from rotational fluctuation of the camshaft. This prevents the vanes from colliding against the walls of their chambers, which produces noise.

16 Claims, 6 Drawing Sheets

VARIABLE VALVE TIMING MECHANISM FOR INTERNAL COMBUSTION ENGINE

BACKGROUND OF THE INVENTION

The present invention relates to a mechanism for varying the valve timing of a set of intake valves or a set of exhaust valves in an engine.

Several types of apparatuses for varying the timing of engine valves have been proposed. Japanese Unexamined Patent Publication No. 1-92504, corresponding to U.S. Pat. No. 4,858,572, discloses a "valve opening timing controller", which functions as a variable valve timing mechanism (VVT).

As shown in FIGS. 10 and 11, the mechanism includes a vane body (inner rotor) 102, which is secured to the distal end (left end as viewed in FIG. 10) of a cam shaft 101, and a timing pulley 103, which rotates in relation to the vane body 102 and the camshaft 101. The vane body 102 has a plurality of vanes 105 radially extending therefrom.

As shown in FIG. 11, a plurality of recesses 106 are defined in the timing pulley 103. A vane 105 is located in each recess 106. Each vane 105 defines two hydraulic chambers 109, one on each of its sides (only the chambers 109 corresponding to one side of the vanes 105 are shown in FIG. 11) in the corresponding recess 106. Hydraulic chambers 109 rotate the vane body 102.

Each hydraulic chamber 109 is connected with a switching valve and an oil pump (neither of which is shown) by hydraulic passages 120 (only parts of which are shown in FIG. 11). The oil pump supplies pressurized oil to the hydraulic chambers 109 through the passages 120.

The timing pulley 103 has radially extending holes 111 and 112. The holes 111 and 112 slidably accommodate lock pins 113 and 114, respectively. The holes 111 and 112 also accommodate springs 115 and 116, respectively. The springs 115, 116 urge the pins 113 and 114 toward the axis of the camshaft 101.

Lock recesses 117 and 118 are formed in the vane body 102. The lock pins 113 and 114 are engageable with the recesses 117 and 118, respectively. Each of the lock recesses 117 and 118 is communicated with one of the hydraulic chambers 109. Part of the oil supplied to the hydraulic chambers 109 from the oil pump fills the lock recesses 117 and 118.

The timing pulley 103 is locked in relation to the vane body 102 when one of the lock pins 113 and 114 is engaged with the corresponding lock recess 117, 118. The engagement prevents the timing pulley 103 from rotating with respect to the vane body 102. Accordingly, the valve timing of the valves, which are actuated by the camshaft 101, is fixed to an advanced position or to a retarded position. When changing the valve timing, one of the lock pins 113, 114 that is engaged with the associated recess 117, 118 is disengaged from the lock recess 117, 118 by the pressure of oil supplied to the lock recess 117, 118. Then, pressure in the hydraulic chambers 109 acts on the vanes 105 thereby changing the rotational phase of the vane body 102 in relation to the timing pulley 103. In this manner, the valve timing of the valves is changed.

The torque of the camshaft 101 is not constant. That is, the torque periodically fluctuates in accordance with opening and closing of the valves, which are actuated by the camshaft 101. The torque fluctuation results in a constant force that rocks the vane body 102 with respect to the timing pulley 103.

When one of the lock pins 113, 114 is engaged with the corresponding lock recess 117, 118, the vane body 102 and the timing pulley 103 do not rotate relative to each other. The torque fluctuation does not rock the vane body 102 with respect to the timing pulley 103 when they are locked together. When neither of the lock pins 113 and 114 is engaged with its corresponding recess 117, 118, if the pressure of oil supplied to the hydraulic chambers 109 is sufficient, the pressure prevents the vane body 102 from rocking.

However, when the engine is being cranked or being stopped, the oil pump displaces a small amount of oil. Accordingly, the oil pressure in the hydraulic chambers 109 is small. In this case, if the lock pins 113 and 114 are out of the lock recesses 117, 118, the vane body 102 is rocked by the torque fluctuation of the camshaft 101.

The rocking of the timing pulley 103 fluctuates the valve timing of the valves thereby degrading the accuracy of the valve timing control. The fluctuation of the valve timing causes the vanes 105 to periodically collide with the inner walls of the recesses 106, which produces noise.

SUMMARY OF THE INVENTION

Accordingly, it is an objective of the present invention to provide a variable valve timing mechanism that prevents a vane body from being rotated relative to a housing by torque fluctuation of a camshaft when fluid pressure in hydraulic chambers is low.

To achieve the above objective, the present invention provides a variable valve timing mechanism for an internal combustion engine, the engine having a drive shaft, a supply of hydraulic fluid, a driven shaft driven by the drive shaft, and at least one valve driven by the driven shaft, wherein the driven shaft has a torque fluctuation as a result of driving the valve, and wherein the mechanism varies the rotational phase of the driven shaft with respect to the drive shaft to vary the timing of the valve, the mechanism including a first rotor that rotates in synchronism with the drive shaft and a second rotor that rotates in synchronism with the driven shaft, wherein the position of the second rotor with respect to the first rotor is varied by the mechanism to change the rotational phase of the driven shaft with respect to the drive shaft. The mechanism including an actuating member movable in a first direction and in a second direction, wherein the second direction is opposite to the first direction, and wherein the movement of the actuating member rotates the second rotor with respect to the first rotor to change the rotational phase of the driven shaft with respect to the drive shaft, the actuating member having a first side and a second side, wherein the second side is opposite to the first side, a first hydraulic chamber located on the first side of the actuating member, a second hydraulic chamber located on the second side of the actuating member, wherein hydraulic pressure is selectively supplied to one of the first and second hydraulic chambers, and a lock member for locking the second rotor to the first rotor in a predetermined position to fix the rotational phase of the driven shaft with respect to the drive shaft, wherein the lock member is movable between a locked position and an unlocked position, wherein the lock member locks the actuating member with respect to the hydraulic chambers to lock the second rotor with respect to the first rotor in the locked position, and wherein the lock member releases the actuating member to unlock the second rotor with respect to the first rotor in the unlocked position, wherein the lock member remains in the locked position until the pressure of the hydraulic fluid supply increases to a predetermined value to prevent the second rotor from fluctuating rotationally due to the torque fluctuation of the driven shaft.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings.

DETAILED DESCRIPTION OF THE PREFERRED EMBODIMENTS

Figure 2:
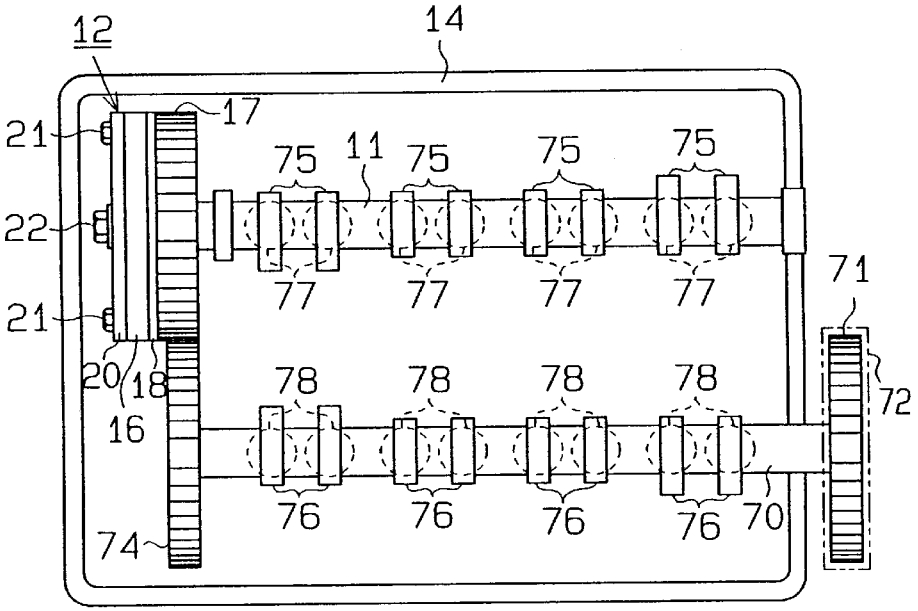
FIG. 2 is a diagrammatic plan view illustrating the camshafts and the VVT of FIG. 1.

A variable valve timing mechanism according to a first embodiment of the present invention will hereafter be described with reference to the drawings. In this embodiment, a variable valve timing mechanism 12 (hereinafter referred to as a VVT) is provided on an intake camshaft 11 of a gasoline engine. Referring to FIG. 2, the general construction of a valve actuating mechanism will be described. In FIG. 2, the left side is defined as the rear side and the right side is defined as the front side of the engine.

An intake camshaft 11 and an exhaust camshaft 70 are rotatably supported on a cylinder head 14. The camshafts 11, 70 have a plurality of cams 75, 76, respectively. Intake valves 77 and exhaust valves 78 are located below the cams 75, 76. A drive gear 74 attached to the rear end of the exhaust camshaft 70 meshes with a driven gear 17, which is attached to the rear end of the intake camshaft 11. A pulley 71 is attached to the front end of the exhaust camshaft 70 and is operably coupled to a crankshaft (not shown) by a timing belt 72.

Rotation of the crankshaft is transmitted to the pulley 71 by the timing belt 72 thereby rotating the exhaust camshaft 70. Rotation of the exhaust camshaft 70 is transmitted to the intake camshaft 11 by the gears 74 and 17. Rotation of the camshafts 11, 70 causes the cams 75 and 76 to open and close the intake valves 77 and the exhaust valves 78.

Figure 1:
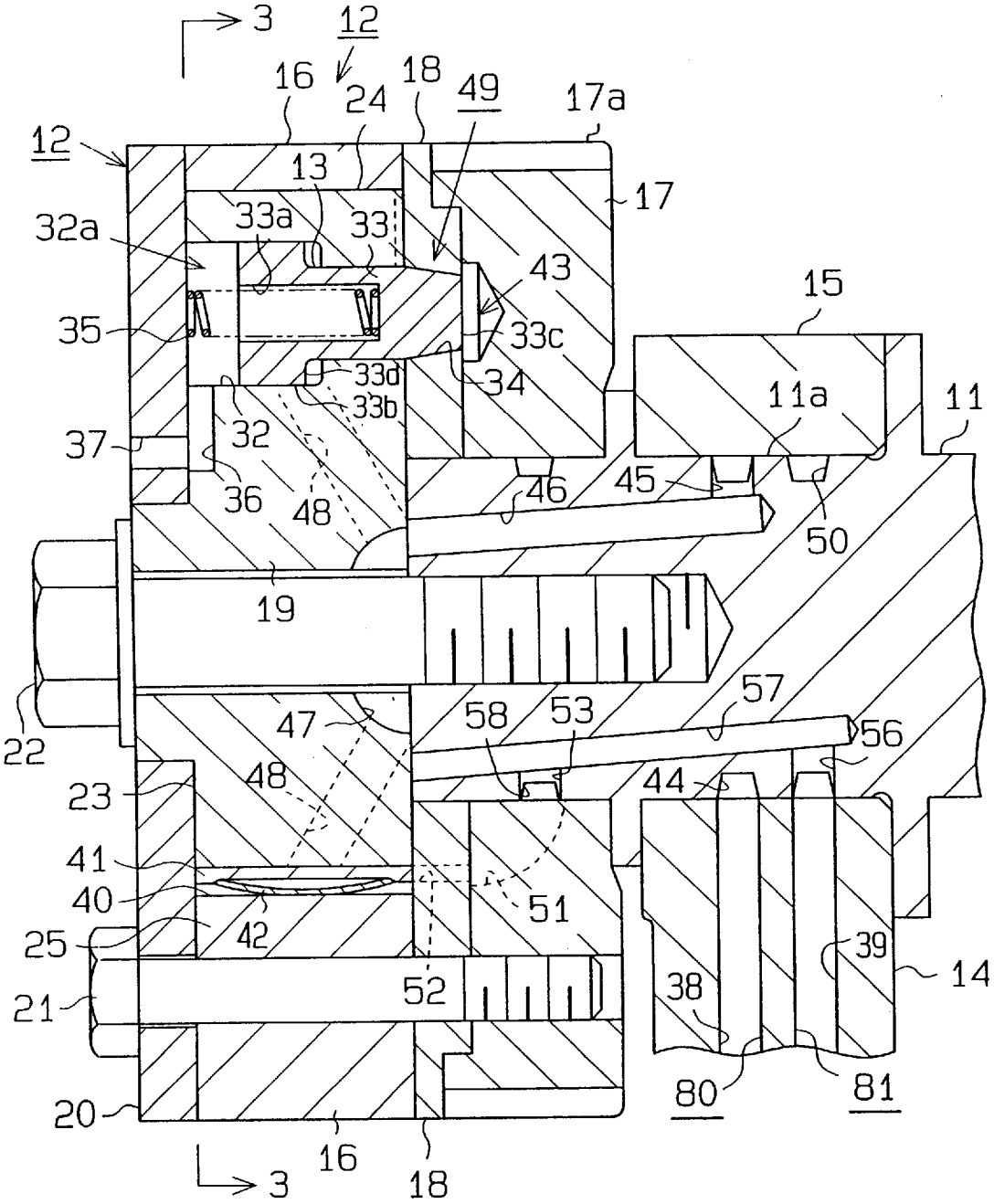
FIG. 1 is a partial cross-sectional view illustrating a VVT according to a first embodiment of the present invention.

The VVT 12 is provided on the rear end of the intake camshaft 11. As shown in FIG. 1, the intake camshaft 11 has a journal 11*a* near its rear end. The journal 11*a* is rotatably supported by the cylinder head 14 and a bearing cap 15. The driven gear 17 is attached to the rear end of the camshaft 11. The driven gear 17 rotates relative to the camshaft 11 and has a plurality of teeth 17*a* formed on its periphery. The teeth 17*a* mesh with teeth 74*a* formed on the periphery of the drive gear 74.

A plate 18, a housing 16 and a cover 20 are provided on the rear end of the driven gear 17. The parts 18, 16, 20 are arranged in this order from the rear end of the gear 17 and secured to the gear 17 by a plurality of bolts 21. The plate 18, the housing 16 and the cover 20 therefore rotate integrally with the driven gear 17.

A vane body 19 is located in a space defined by the plate 18, the housing 16 and the cover 20. The vane body 19 is secured to the rear end of the camshaft 11 by a bolt 22. A knock-pin (not shown) is provided to prevent the vane body 19 from rotating relative to the camshaft 11. Thus, the vane body 19 rotates integrally with the camshaft 11.

Figure 3:
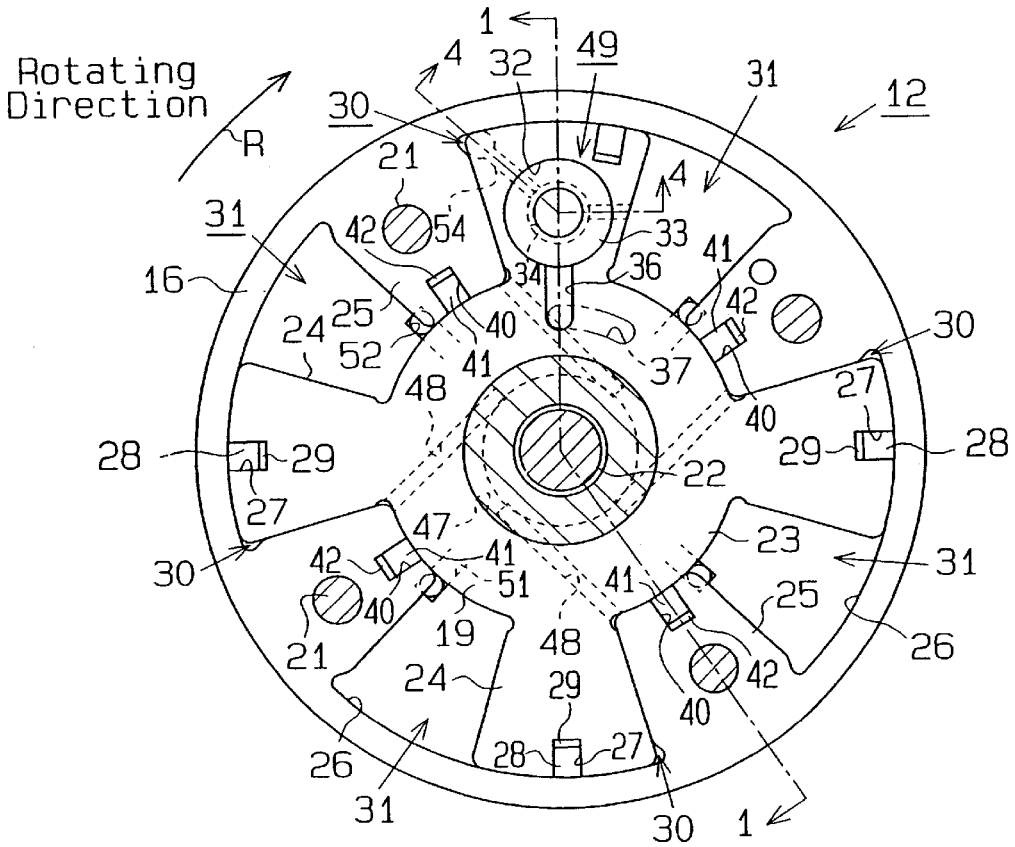
FIG. 3 is a cross-sectional view taken along line 3—3 of FIG. 1.

As shown in FIG. 3, the vane body 19 includes a cylindrical boss 23 and four vanes 24 projecting radially form the boss 23. The housing 16 includes four projections 25 projecting inward from its inner circumference. Each pair of adjacent projections 26 define a recess 26. Each recess 26 accommodates one of the vanes 24. The outer circumference of each vane 24 contacts the inner circumference of the corresponding recess 26, and the inner circumference of each projection 25 contacts the outer circumference of the boss 23.

Each recess 26 is divided into two spaces by the corresponding vane 24 and the boss 23. That is, a first hydraulic chamber 30 and a second hydraulic chamber 31 are defined on the sides of each vane 24, respectively. The first hydraulic chamber 30 is located on the trailing side with respect to the rotating direction (represented by an arrow R in FIG. 3) of the driven gear 17, while the second hydraulic chamber 31 is located on the leading side. The rotating direction of the driven gear 17 will hereafter be referred to as the phase advancing direction and the opposite direction will be referred to as the phase retarding direction. Oil is supplied to the first hydraulic chambers 30 when advancing the valve timing of the intake valves 77. Oil is supplied to the second hydraulic chambers 31 when retarding the valve timing of the valves 77.

Grooves 27 and 40 are formed in the distal ends of the vanes 24 and the projections 25. A seal 28 and a leaf spring 29 are accommodated in each groove 27. Each spring 29 urges the corresponding seal 28 toward the inner circumference of the housing 16. Likewise, a seal 41 and a leaf spring 42 are accommodated in each groove 40. Each spring 42 urges the corresponding seal 41 toward the circumference of the boss 23 . The seals 28 and 41 seal the hydraulic chambers 30, 31 from each other thereby preventing oil from moving between the chambers 30 and 31.

As shown in FIG. 1, one of the vanes 24 has a bore 32 extending parallel to the axis of the camshaft 11. A step is defined in the bore 32. A lock pin 33 is accommodated in the bore 32. The lock pin 33 moves in the axial direction of the camshaft 11 (horizontally, as viewed in FIG. 1) and has a large diameter portion 33*b* at its rear side. A bore 33*a* is formed in the large diameter portion 33*b*, and the bore 33*a* opens to the rear end of the pin 33. The bore 33*a* receives one end of a spring 35. The spring 35 extends between the cover 20 and the bottom of the bore 33*a* and constantly urges the lock pin 33 toward a lock hole 34.

The lock hole 34 is formed in the plate 18. The front end of the lock pin 33 engages with the lock hole 34. More specifically, the lock pin 33 is engaged with the lock hole 34 when the vane body 19 is located at the most retarded position relative to the housing 16, and each vane 24 contacts the corresponding projection 25. This position of the vane body 19 will hereafter be referred to as the most retarded position.

Figure 4:
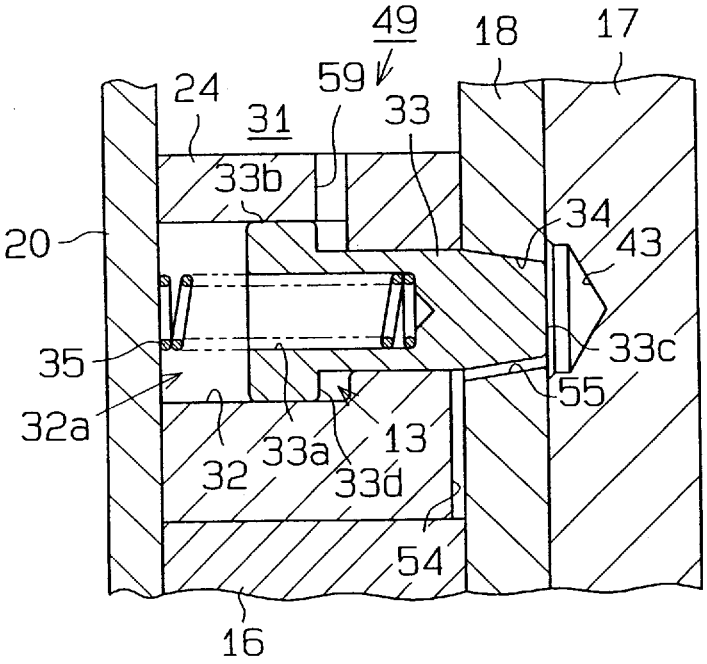
FIG. 4 is an enlarged partial cross-sectional view illustrating the lock mechanism of the VVT of FIG. 1 when in a locked position.

As shown in FIG. 4, an oil recess 43 is formed in the rear end face of the driven gear 17 in an area facing the lock hole 34. An oil groove 55 is formed in the inner wall of the lock hole 34. The oil groove 55 communicates with the oil recess 43. The oil groove 55 also communicates with the an oil passage 54 formed in the front end face of one of the vanes 24. Since the oil passage 54 communicates one of the first hydraulic chamber 30, as illustrated in FIG. 3, the groove 55 is connected with the first hydraulic chamber 30 by the oil passage 54.

Figure 5:
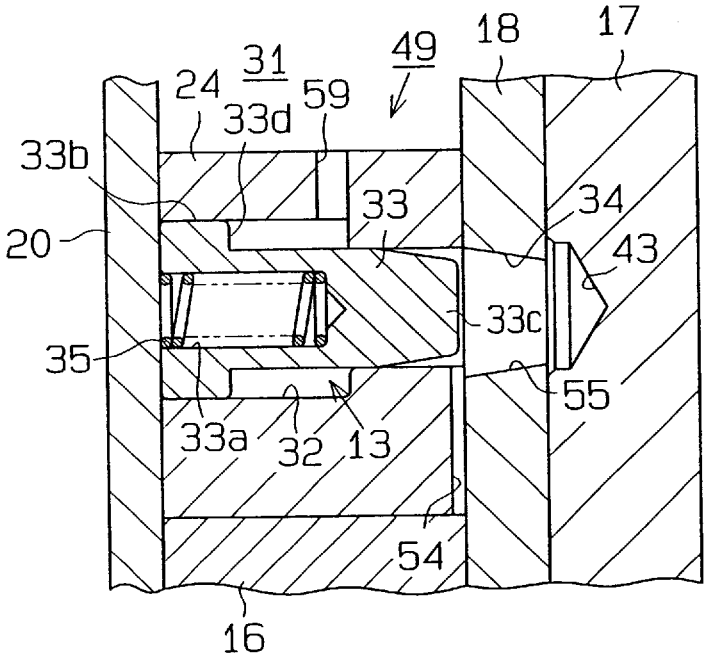
FIG. 5 is an enlarged partial cross-sectional view illustrating the lock mechanism of FIG. 4 when in a released position.

Therefore, when the lock pin 33 is engaged with the lock hole 34 as illustrated in FIG. 4, some of the oil supplied to the corresponding first hydraulic chamber 30 enters the oil recess 43 through the oil passage 54 and the oil groove 55. When the lock pin 33 is not engaged with the lock hole 34, as illustrated in FIG. 5, some of the oil supplied to in the first hydraulic chamber 30 enters the lock hole 34 and the oil recess 43 through the oil passage 54 and the oil groove 55.

The front end face of the lock pin 33 (right end face as viewed in FIGS. 4 and 5) functions as a first pressure receiving surface 33*c*. The pressure of oil in the lock hole 34 and in the oil recess 43 acts on the first pressure receiving surface 33*c* thereby urging the lock pin 33 rearward.

An annular oil chamber 13 is defined between the large diameter portion 33*b* and the inner wall of the bore 32. The oil chamber 13 communicates with the one of the second hydraulic chambers 31 via an oil passage 59.

Therefore, some of the oil supplied to the corresponding second hydraulic chamber 31 enters the oil chamber 13 via the oil passage 59. The front end of the large diameter portion 33*b* functions as a second pressure receiving surface 33*d*. The pressure of oil introduced in the oil chamber 13 acts on the second pressure receiving surface 33*d* thereby urging the lock pin 33 rearward.

As shown in FIG. 1, a vent groove 36 is formed on the rear face of the vane body 19. The vent groove 36 is connected with the rear end of the bore 32. A vent hole 37 is formed in the cover 20 as shown in FIG. 3 for communicating the vent groove 36 with the atmosphere. Thus, a space 32*a* defined between the rear end face of the lock pin 33 and the cover 20 is opened to the outside through the vent groove 36 and the vent hole 37.

The lock pin 33, the lock hole 34, the spring 35, the oil recess 43 and the oil chamber 13 constitute a lock mechanism 49 for restricting rotation of the vane body 19 relative to the housing 16.

When the force of the spring 35 is greater than the force of oil pressure acting on the first pressure receiving surface 33*c* and on the second pressure receiving surface 33*d*, the lock pin 33 enters in the hole 34 as illustrated in FIG. 4. The lock mechanism 49 is thus in the locked position. When in the locked position, the mechanism 49 fixes the position of the vane body 19 relative to the housing 16. Accordingly, relative rotation between the housing 16 and the vane body 19 is prohibited, and the camshaft 11 rotates integrally with the driven gear 17.

When the force of oil pressure acting on the first and second pressure receiving surfaces 33*c* and 33*d* is greater than the force of the spring 35, the lock pin 33 is disengaged from the lock hole 34 and fully retracted in the bore 32. The lock mechanism 49 is therefore in the released position. When in the released position, the mechanism 49 allows the vane body 19 to rotate relative to the housing 16.

As described above, the space 32*a* defined in the rear portion of the bore 32 communicates with the atmosphere. Therefore, when the volume of the space 32*a* is changed by movement of the lock pin 33, the air pressure in the space 32*a* does not hinder the movement of the lock pin 33. Oil in the oil chamber 13 may leak into the space 32*a*. In this case, the oil is drained to the outside through the vent groove 36 and the vent hole 37. Thus, oil that has leaked into the space 32*a* does not hinder the movement of the lock pin 33.

A construction for supplying oil to the first hydraulic chambers 30 and to the second hydraulic chambers 31 will now be described with reference to FIG. 1.

A pair of supply passages 38, 39 are defined in the cylinder head 14. The passages 38, 39 are connected to an oil pump (not shown) by an oil control valve (not shown, hereinafter referred to as OCV). The oil pump is actuated by the crankshaft of the engine and draws oil from an oil pan (not shown) and sends the oil to the OCV. The OCV then selectively supplies the oil to the passage 38 or to the passage 39.

The passage 38 is defined in the rear portion of the cylinder head 14 and is connected to an oil passage 46 defined in the camshaft 11 by an oil groove 44 formed in the entire circumference of the journal 11*a* and an oil bore 45 formed along the journal 11*a*. An annular space 47 is formed in the front end face of the vane body 19 about the bolt 22. The rear end of the oil passage 46 opens to the annular space 47.

Further, four radially extending oil holes 48 are defined in the boss 23. The holes 48 communicate the annular space 47 with the first hydraulic chambers 30.

The supply passage 38, the oil groove 44, the oil hole 45, the oil passage 46, the annular space 47 and the oil holes 48 constitute a first oil conduit 80. The OCV is controlled by an electronic control unit of the engine and supplies oil from the oil pump to the first hydraulic chambers 30 through the first oil conduit 80 or drains oil in the first hydraulic chambers 30 to the oil pan through the first oil conduit 80.

The oil passage 39 is formed in the front portion of the cylinder head 14 and is connected to an oil groove 50 formed along the entire circumference of the journal 11*a*. An oil passage 57 is defined in the cam shaft 11. The front end of the passage 57 is connected to the groove 50 by an oil hole 56 formed in the camshaft 11. An oil groove 58 is formed along the entire circumference of the camshaft 11 at an axial position corresponding to the position of engaged with the driven gear 17. The groove 58 is connected to the rear portion of the oil passage 57 by an oil hole 53 formed in the camshaft 11.

Four quarter-circular grooves 51 are formed in the center portion of the driven gear 17. The grooves 51 are connected to the oil groove 58. As shown in FIG. 3, four oil holes 52 are formed in the plate 18. Each hole 52 opens in the vicinity of one of the projections 25. The holes 52 communicate the quarter-circular grooves 51 with the second hydraulic chambers 31.

The supply passage 39, the oil groove 50, the oil hole 56, the oil passage 57, the oil hole 53, the oil groove 58, the quarter-circular grooves 51 and the oil holes 52 constitute a second oil conduit 81. The OCV is controlled by the electronic control unit and supplies oil from the oil pump to the second hydraulic chambers 31 through the second oil conduit 81 or drains oil in the second hydraulic chambers 31 to the oil pan through the second oil conduit 81.

Changing the valve timing of the intake valves 77 will now be described. In the following case, cranking of the engine is completed and the oil pump is displacing a sufficient amount of oil.

First, advancing the valve timing of the intake valves 77 will be explained. In this case, the OCV is controlled to connect the first oil conduit 80 with the oil pump and the second oil conduit 81 with the oil pan. Therefore, oil is supplied to the first hydraulic chambers 30 through the first oil conduit 80, while oil in the second hydraulic chambers 31 is drained to the oil pan through the second oil conduit 81.

Oil pressure that is equal to the pressure in the first hydraulic chambers 30 acts on the first pressure receiving surface 33*c* of the lock pin 33. The oil pressure causes the lock pin 33 to be entirely retracted in the bore 32 (see FIG. 5). Thus, the lock mechanism 49 is in the released position.

In this manner, supplying oil to the first hydraulic chambers 30 and draining oil from the second hydraulic chambers 31 increases the oil pressure in the first hydraulic chambers 30 relative to the oil pressure in the second hydraulic chambers 31. The pressure in the first hydraulic chambers 30 moves the vanes 24 thereby displacing the vane body 19 in the phase advancing direction in relation to the housing 16. The camshaft 11 is integrally rotated with the vane body 19 in relation to the housing 16. In this manner, the valve timing of the intake valves 77 is advanced.

Further rotation of the vane body 19 in the phase advancing direction in relation to the housing 16 causes the vanes 24 to contact the projections 25. This position of the vane body 19 is referred to as the most advanced position. When the vane body 19 is in the most advanced position, the valve timing of the intake valves 77 is most advanced.

Next, retarding the valve timing of the intake valves 77 will be explained. In this case, the OCV is controlled to connect the second oil conduit 81 with the oil pump and the first oil conduit 80 with the oil pan. Therefore, oil is supplied to the second hydraulic chambers 31 through the second oil conduit 81 and oil in the first hydraulic chambers 30 is drained to the oil pan through the first oil conduit 80.

Oil pressure that is equal to the pressure of the second hydraulic chambers 31 acts on the second pressure receiving surface 33*d* of the lock pin 33. The oil pressure causes the lock pin 33 to be entirely retracted in the bore 32 (see FIG. 5). Thus, the lock mechanism 49 is in the released position.

In this manner, supplying oil to the second hydraulic chambers 31 and draining oil from the first hydraulic chambers 30 increases the oil pressure in the second hydraulic chambers 31 relative to the oil pressure in the first hydraulic chambers 30. The pressure in the second hydraulic chambers 31 moves the vanes 24 thereby displacing the vane body 19 in the phase retarding direction in relation to the housing 16. The camshaft 11 is integrally rotated with the vane body 19 in relation to the housing 16. In this manner, the valve timing of the intake valves 77 is retarded.

Further rotation of the vane body 19 in the phase retarding direction in relation to the housing 16 causes the vane body 19 to be at the most retarded position. When the vane body 19 is in the most retarded position, the valve timing of the intake valves 77 is most retarded. In this case, the second pressure receiving surface 33*d* is receiving oil pressure that is great enough to cause the lock pin 33 to be entirely retracted in the bore 32. The lock pin 33 is therefore not engaged with the lock hole 34.

Stopping of the above described valve timing changes will now be described. That is, fixing of the position of the vane body 19 relative to the housing 16, thus fixing the vale timing, will be described.

In this case, the OCV is controlled to disconnect the first oil conduit 80 and the second oil conduit 81 from the oil pump and the oil pan. This stops the supply of oil to the hydraulic chambers 30, 31 and drains oil from the hydraulic chambers 30, 31 through the oil conduits 80, 81. As a result, the pressures in the hydraulic chambers 30, 31 are equalized. This stops the rotation of the vane body 19 relative to the housing 16. Consequently, the valve timing of the intake valves 77 is fixed to the current timing.

As described above, the VVT 12 continuously advances or retards the valve timing of the intake valves 77 and fixes the valve timing of the intake valves 77 at a desired timing.

Figure 6:
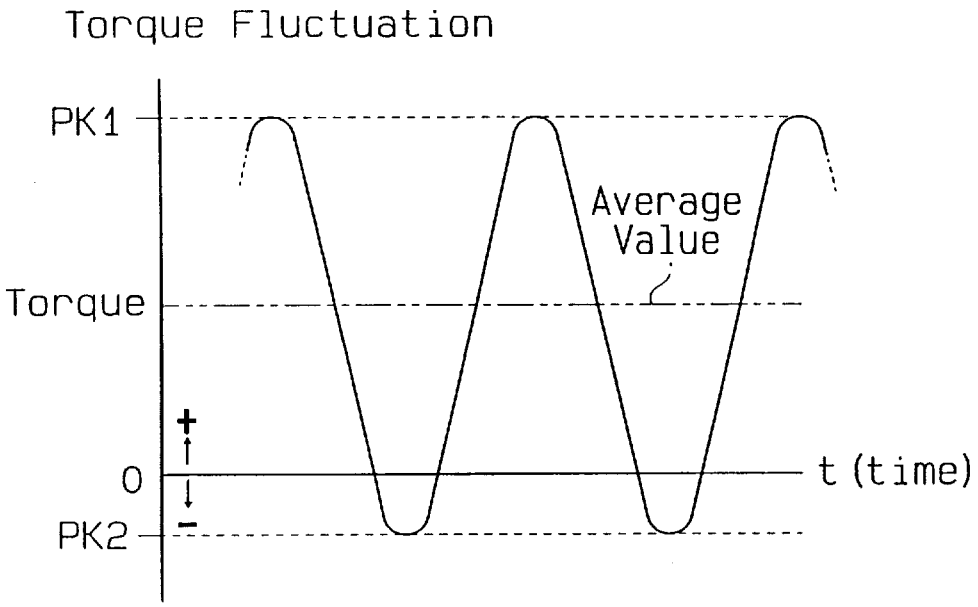
FIG. 6 is a graph showing torque fluctuation of the camshaft of FIG. 1.

The torque of the camshaft 11 is not constant but is changed in accordance with opening and closing of the intake valves 77. As shown in FIG. 6, the torque of the camshaft 11 periodically fluctuates between a peak value PK1 of positive torque, which is produced when opening the valve 77, and a peak value PK2 of negative torque, which is produced when closing the valve 77. Positive torque refers to a torque rotating the camshaft 11 in the phase retarding direction and negative torque refers to a torque rotating the shaft 11 in the phase advancing direction.

As shown in FIG. 6, the absolute value of the positive torque peak value PK1 is greater than the absolute value of the negative torque peak value PK2. Therefore, the average value of the torque is in the positive torque region as illustrated by a two-dot chain line. Thus, the torque rotates the camshaft 11 in the phase retarding direction.

When the engine is being stopped, the oil pressure in the hydraulic chambers 30, 31 is lowered. When the pressure in the chambers 30, 31 is lower than a certain level, the pressure can no longer hold the vane 24 at the current position. In this case, torque fluctuation of the camshaft 11 causes the vane body 19 to act in the following manner.

When the engine is being stopped, the OCV is controlled to connect the second oil conduit 81 with the oil pump and the first oil conduit 80 with the oil pan. This increases the pressure in the second hydraulic chambers 31 relative to the pressure in the first hydraulic chambers 30. The vane body 19 is thus rotated in the phase retarding direction. The vane body 19 is rotated not only by the pressure in the second hydraulic chamber 31 but also by the torque of the camshaft 11. When the vane body 19 reaches the most retarded position, the valve timing of the intake valves 77 is also most retarded.

If the pressure in the second hydraulic chambers 31 is sufficient, the pressure constantly pushes the vanes 24 against the projections 25. Therefore, the vane body 19 is not affected by torque fluctuations of the camshaft 11 and is maintained at the most retarded position.

However, when stopping the engine, a decrease in the engine speed, or a decrease in the crankshaft speed, results in an abrupt decreases in the amount of oil displaced from the oil pump. Accordingly, the pressure in the second hydraulic chambers 31 is lowered. When the pressure in the second hydraulic chambers 31 is lower than a certain level, negative torque of the camshaft 11 (see FIG. 6) temporarily rotates the vane body 19 in the phase advancing direction relative to the housing 16.

When the torque of the camshaft 11 changes to positive torque from negative torque, the vane body 19, which has been rotated in the phase advancing direction relative to the housing 16, is rotated in the phase retarding direction and returned to the most retarded position.

That is, the position of the vane body 19 is changed in accordance with the torque fluctuations of the camshaft 11 and each vane 24 rocks in the associated recess 26. Although the rocking of the vanes 24 continuously only until the rotation of the camshaft 11 is completely stopped, the repeated collisions of vanes 24 against the projections 25 produce noise.

For reducing the noise, the area SA2 of the second pressure receiving surface 33*d* of the lock pin 33 and the force F1 of the spring 35 are defined as follows.

After the vane body 19 reaches the most retarded position and immediately before the lock mechanism 49 enters the locked position, that is, immediately before the lock pin 33 enters the lock hole 34, the force of the spring 35 is equal to the force of the oil pressure PA2 acting on the second pressure receiving surface 33*d*. The force of the pressure PA2 is obtained by multiplying the pressure PA2 by the area SA2 of the surface 33*d* (PA2×SA2). The pressure PA2 in the oil chamber 13 is obtained by the following equation.

$$PA2=F1/SA2 \quad (1)$$

In this state, a pressure that is equal to the pressure in the first hydraulic chambers 30 is acting on the first pressure receiving surface 33*c* of the lock pin 33. However, the first oil conduit 80 is connected with the oil pan and the pressure acting on the surface 33*c* is thus negligible compared to the pressure PA2 in the oil chamber 13. Therefore, the pressure acting on the surface 33*c* is not taken into consideration in the equation (1).

On the other hand, when the torque of the camshaft 11 is at the peak value PK2, the torque resulting from the pressure PB2 in the second hydraulic chambers 31 needs to be greater than the peak value PK2 of the torque of the camshaft 11 for preventing the rocking of the vanes 24. That is, the following inequality needs be satisfied.

$$PK2<N\times PB2\times SB2\times(R1+R2)/2 \quad (2)$$

The right side of the inequality (2) is the torque based on the pressure PB2 in the second hydraulic chambers 31 acting on the vanes 24 in the phase retarding direction. N is the number of vanes 24 (in this embodiment, N is four). SB2 is the area of a side of each vane 24 that faces the second hydraulic chamber 31. R1 is the length from the center of the vane body 19 (rotational axis of the camshaft 11) to the periphery of the vane 24. R2 is the length from the center of the vane body 19 to the periphery of the boss 23.

Since the oil chamber 13 communicates with one of the second hydraulic chambers 31, the pressure PA2 in the oil chamber 13 and the pressure PB2 in the second hydraulic chambers 31 are substantially the same (PA2=PB2). Thus, referring to the above equation (1) and the inequality (2), the area SA2 of the second pressure receiving surface 33*d* and the force F1 of the spring 35 satisfy the following inequality (3).

$$F1/SA2>2\times PK2/(N\times SB2\times(R1+R2)) \quad (3)$$

In this embodiment, the area SA2 of the second pressure receiving surface 33*d* and the force F1 of the spring 35 are set to satisfy the inequality (3). Thus, when stopping the engine, the vane body 19 is moved toward the most retarded position. If the pressure in the second hydraulic chambers 31 lowers to a level that fails to suppress the rocking of the vanes 24, the lock pin 33 is pushed into the lock hole 34, that is, the lock mechanism 49 is locked. This prevents the vane 19 from rotating relative to the housing 16.

As described above, if the pressure in the second hydraulic chamber 31 is lowered when, for example, stopping the engine, the lock mechanism 49 enters the locked position and prevents the vanes 24 from rocking. This eliminates the noise caused by the rocking of the vanes 24.

When the vane body 19 reaches the most retarded position, the lock mechanism 49 enters the locked position. That is, when the oil pressure in the hydraulic chambers 30, 31 is too low to hold the position of the vanes 24, the vane body 19 is rotated by the torque of the camshaft 11 and reaches the most retarded position. Then, the lock mechanism 49 stops rotation of the vane body 19 relative to the housing 16.

If the lock mechanism 49 is constructed such that the mechanism 49 enters the locked position when the vane body 19 is at the most advanced position, an urging member such as a spring needs to be located in one of the first hydraulic chambers 30. When the pressure in the hydraulic chambers 30, 31 is decreased, the urging member would rotate the vane body 19 in the phase advancing direction relative to the housing 16.

However, the embodiment of FIG. 1–5 requires no additional parts such as the spring and thus simplifies the construction of the VVT. The simplified construction quickly and securely stops the rotation of the vane body 19 relative to the housing 16.

Incidentally, torque fluctuation of the camshaft 11 causes noise in cases other than when the engine is being stopped. For example, when the engine is being cranked, the vane body 19 is moved in the phase advancing direction from the most retarded position. This may cause the vane body 19 to rock as described above thereby producing noise.

When the engine is being cranked, the OCV is in the same state as when the engine is being stopped. That is, the OCV connects the second oil conduit 81 with the oil pump and the first oil conduit 80 with the oil pan. Therefore, oil is supplied to the second hydraulic chambers 31 through the second oil conduit 81. In this state, the second oil conduit 81 and the second hydraulic chambers 31 are filled with oil. When advancing the valve timing of the intake valves 77 from this state, the OCV is controlled to connect the first oil conduit 80 with the oil pump and the second oil conduit 81 with the oil pan.

If the engine has been stopped over a relatively long period of time, most of oil in the first oil conduit 80, the first hydraulic chambers 30, the oil passage 54, the oil groove 55 and the oil recess 43 will have returned to the oil pan. In this case, the parts 80, 30, 54, 43 are not filled with oil.

When supplying oil to the first hydraulic chambers 30 from this state, the pressure in the chambers 30 starts increasing from an extremely low pressure. Before the pressure in the chambers 30 reaches a sufficient level, if the lock mechanism 49 enters the released position from the locked position, positive torque of the camshaft 11 temporarily rotates the vane body 19 in the phase retarding direction. This fluctuates the valve timing of the intake valve 77 and causes the vanes 24 to rock and repeatedly collide with the projections 25. The collisions produces noise. However, immediately after the lock pin 33 is disengaged from the lock hole 34, the rocking of the vane body 19 is prevented if the force based on the pressure in the first hydraulic chambers 30 is greater than the maximum value of the torque fluctuation of the camshaft 11.

For suppressing the valve timing fluctuation and the noise, the area SA1 of the first pressure receiving surface 33*c* of the lock pin 33 and the force F1 of the spring 35 are defined as follows.

The pressure in the oil hole 43 immediately before the lock mechanism 49 enters the released position is represented by PA1. The pressure PA1 satisfies the following equation.

$$PA1=F1/SA1 \quad (4)$$

In this state, a pressure that is equal to the pressure in the second hydraulic chambers 31 is acting on the second pressure receiving surface 33*d* of the lock pin 33. However, the second oil conduit 81 is connected with the oil pan and the pressure acting on the surface 33*d* is thus negligible compared to the pressure PA1 in the oil recess 43. Therefore, the pressure on the surface 33*d* is not taken into consideration in the equation (4).

On the other hand, when the torque of the camshaft 11 reaches the positive peak value PK1, the pressure PB1 in the first hydraulic chambers 30 needs to satisfy the following inequality in order to stop the rocking of the vanes 24.

$$PK1<N\times PB1\times SB1\times(R1+R2)/2 \quad (5)$$

The right side of the equation (4) is the torque resulting from the pressure in the first hydraulic chambers 30 acting on the vanes 24 in the phase advancing direction. SB1 in the inequality (5) is the area of a side of the vane 24 that faces the first hydraulic chamber 30.

Since the oil recess 43 communicates with one of the first hydraulic chambers 30, the pressure PA1 in the oil recess 43 and the pressure PB1 in the first hydraulic chambers 30 are substantially the same (PA1=PB1). Thus, referring to the above equation (4) and the inequality (5), the area SA1 of the first pressure receiving surface 33*c* and the force F1 of the spring 35 satisfy the following inequality (6).

$$F1/SA1>2\times PK1/(N\times SB1\times(R1+R2)) \quad (6)$$

In this embodiment, the area SA1 of the first pressure receiving surface 33*c* and the force F1 of the spring 35 are set to satisfy the inequality (6). If the pressure in the first hydraulic chambers 30 is high enough to suppress the rocking of the vanes 24, the lock mechanism 49 is released.

As described above, when advancing the valve timing of the intake valves 77 immediately after the engine is started, the pressure in the first hydraulic chamber 30 increases to a sufficient level after a certain period of time has elapsed. During this time, the lock mechanism 49 is in the locked position. This prevents the vanes 24 from rocking thereby eliminating the noise caused by the rocking of the vanes 24. The prevention of the vane rocking improves the accuracy of the valve timing control.

The locked position and the released position of the lock mechanism 49 is switched by selectively communicating the pressures in the hydraulic chambers 30, 31 with the pressure receiving surfaces 33*c*, 33*d* of the lock pin 33. Therefore, the construction of the lock mechanism 49 is simple compared to constructions in which the position of the lock mechanism 49 is switched by controlling the lock pin 33 with an electromagnetic solenoid or by an actuator. As a result, the manufacturing cost of the VVT 12 is reduced.

A second embodiment of the present invention will now be described.

To avoid a redundant description, like or the same reference numerals are given to those components that are like or the same as the corresponding components of the first embodiment.

The second embodiment is different from the first embodiment in that the VVT 12 is provided on the exhaust camshaft 70 instead on the intake camshaft 11 and in that a spring is located in each second hydraulic chamber to urge the vane body 19 in the phase advancing direction.

Figure 7:
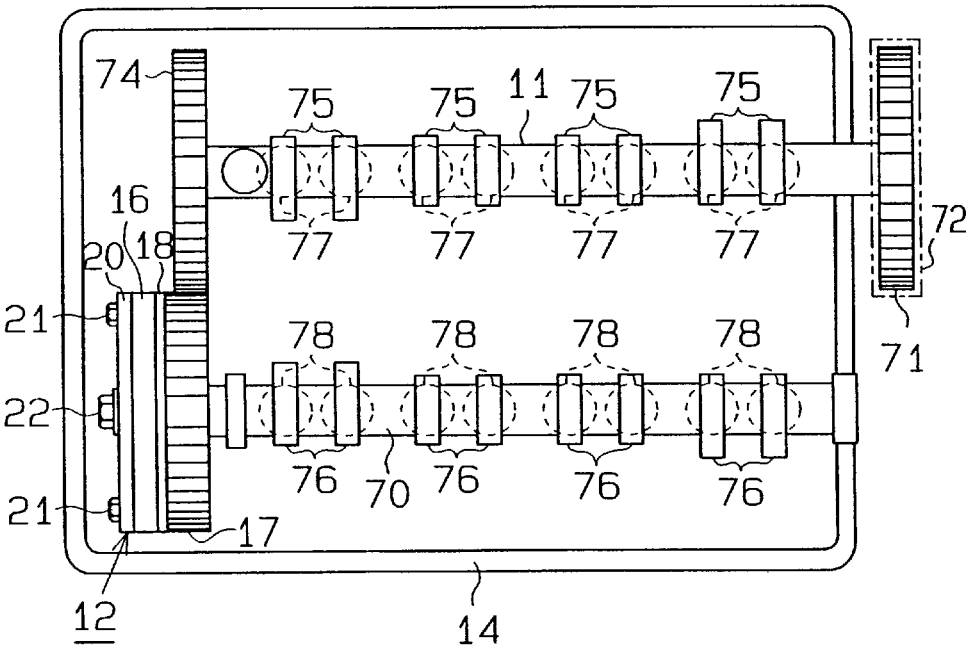
FIG. 7 is a diagrammatic plan view illustrating a camshafts and a VVT according to a second embodiment of the present invention.

As shown in FIG. 7, the VVT 12 is provided on the rear end of the exhaust camshaft 70 for changing the valve timing of the exhaust valves 78. The intake camshaft 11 has a drive gear 74 on the rear end. The drive gear 74 is meshed with the driven gear 17 of the VVT 12. The pulley 17 is secured to the front end of the intake camshaft 11. The pulley 71 is operably coupled to the crankshaft (not shown) by the timing belt 72.

Figure 8:
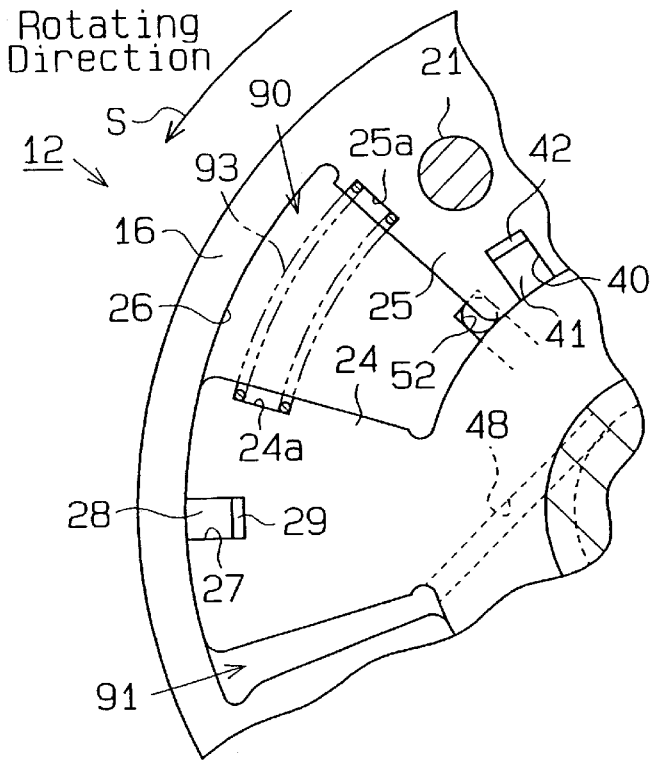
FIG. 8 is an enlarged cross-sectional view illustrating the VVT of FIG. 7.

As shown in FIG. 8, the housing 16 and the driven gear 17 are rotated in a counterclockwise direction, or a direction illustrated by an arrow S. A first hydraulic chamber 90 and a second hydraulic chamber 91 are defined on the sides of each vane 24 in the recess 26. The first hydraulic chamber 90 is located on the trailing side with respect to the rotating direction of the driven gear 17, while the second hydraulic chamber 91 is located on the leading side. The rotating direction of the driven gear 17 is referred to as the phase advancing direction and the opposite direction is referred to as the phase retarding direction. Oil is supplied to the first hydraulic chambers 90 when advancing the valve timing of the exhaust valves 78. Oil is supplied to the second hydraulic chambers 91 when retarding the valve timing of the valves 78.

The first hydraulic chambers 90 of this embodiment are provided in the space corresponding to the second hydraulic chambers 31 of the first embodiment. Likewise, the second hydraulic chambers 91 are provided in the space corresponding to the first hydraulic chambers 30 of the first embodiment. Oil is supplied to and drained from the first hydraulic chambers 90 by a first oil conduit (not shown), which has the same construction as the second oil conduit 81 in the first embodiment, whereas oil is supplied to and drained from the second hydraulic chambers 91 by a second oil conduit (not shown), which has the same construction as the first oil conduit 80 in the first embodiment.

The VVT 12 of the second embodiment has a lock mechanism 49, which has the same construction (see FIGS. 4 and 5) as the lock mechanism 49 of the first embodiment. In this embodiment, the oil recess 43 is communicated with the second hydraulic chambers 91 by the oil groove 55 and the oil passage 54. Therefore, pressure in the second hydraulic chambers 91 acts on the first pressure receiving surface 33*c* of the lock pin 33. On the other hand, the oil chamber 13 is communicated with the first hydraulic chambers 90 by the oil passage 59. Therefore, pressure in the first hydraulic chambers 90 acts on the second pressure receiving surface 33*d*.

Unlike the first embodiment, the lock mechanism 49 is locked when the vane body 19 has rotated in the phase advancing direction and each vane 24 contacts the corresponding projection 25. In other words, the lock mechanism 49 enters the locked position when the vane body 19 is at the most advanced position. Thus, the lock hole 34 illustrated in FIGS. 4 and 5 is formed in the plate 18 in a location such that the lock pin 33 is engaged with the lock hole 34 when the vane body 19 is at the most advanced position. The oil recess 43 is formed in the rear face of the driven gear 17 at an area facing the lock hole 34.

As shown in FIG. 8, a spring 93 is located in each first hydraulic chamber 90 (only one is shown in FIG. 8). The ends of each spring 93 are secured to recesses 24*a*, 25*a* formed in the vane 24 and the projection 25, respectively.

The springs 93 urge the vane 24 toward the second hydraulic chambers 91 thereby rotating the vane body 19 in the phase advancing direction relative to the housing 16.

As in the first embodiment, the lock mechanism 49 of this embodiment prevents rocking of the vanes 24 in the recesses 26. That is, the area SA1 of the first pressure receiving surface 33*c*, the area SA2 of the second pressure receiving surface 33*d* and the force F1 of the spring 35 satisfy the following inequalities (7) and (8).

$$F1/SA1>2\times(PK4+T1)/(N\times SB4\times(R1+R2)) \quad (7)$$

$$F1/SA2>2\times(PK3-T1)/(N\times SB3\times(R1+R2)) \quad (8)$$

SB4 represents the area of a side of the vane 24 facing the second hydraulic chamber 91 and SB3 represents the area of a side of the vane 24 facing the first hydraulic chamber 90. PK4 represents the peak value of the negative torque of the torque fluctuation of the exhaust camshaft 70 and corresponds to the peak value PK2 of the intake camshaft 11. PK3 represents the peak value of the positive torque of the torque fluctuation of the exhaust camshaft 70 and corresponds to the peak value PK1 of the intake camshaft 11. T1 represents the torque produced by the springs 93 acting on the vane body 19 when the vane body 19 is at the most advanced position.

Positive torque refers to a torque that rotates the exhaust camshaft 70 in the phase retarding direction. Negative torque refers to a torque that rotates the shaft 70 in the phase advancing direction.

The inequalities (7) and (8) are obtained in substantially the same manner as the inequalities (3) and (6).

As in the first embodiment, the rocking of the vanes 24 caused by torque fluctuation is prevented by the lock mechanism 49. This improves the accuracy of the valve timing control and prevents noise produced by collisions of the vanes 24 and the projections 25.

When stopping the engine, the vane body 19 is held at the most advanced position in the following manner. That is, when stopping the engine, the OCV is controlled to connect the first oil conduit with the oil pump and the second oil conduit with the oil pan. Therefore, the vane body 19 is rotated in the phase advancing direction relative to the housing 16 by the pressure of the first hydraulic chambers 90.

At this time, the vane 19 is rotated not only by the pressure in the first hydraulic chambers 90 but also by the force of the springs 93. Thus, when the displacement of the oil pump is relatively low and the pressure in the first hydraulic chambers 90 is low, the vane body 19 is not rotated in the phase retarding direction by torque fluctuation of the exhaust camshaft 70.

In this manner, the vane body 19 is rotated in the phase advancing direction and reaches the most advanced position. If the oil pressure in the first hydraulic chambers 90 is further lowered, the lock pin 33 enters the lock hole 34, that is, the lock mechanism 49 enters the locked position. As a result, relative rotation of the housing 16 and the vane body 19 is prohibited and the valve timing of the exhaust valves 78 is fixed at a timing that is at the most advanced timing.

For facilitating the starting of the engine, the valve overlap, in which the intake valves 77 and the exhaust valves 78 are simultaneously open, is preferably short. If the valve overlap is too long when the engine is being cranked, air-fuel mixture in the combustion chamber may flow back to the intake passage. The flowing back of the mixture is called spitting. Spitting degrades the volumetric efficiency of intake air thereby making the engine harder to start.

In this embodiment, the valve timing of the exhaust valves 78 is most advanced when the engine is stopped. This minimizes the valve overlap. When the engine is started again, the valve overlap is minimum. Spitting of the engine is thus prevented and engine starting is improved.

It should be apparent to those skilled in the art that the present invention may be embodied in many other specific forms without departing from the spirit or scope of the invention. Particularly, it should be understood that the invention may be embodied in the following forms.

Figure 9:
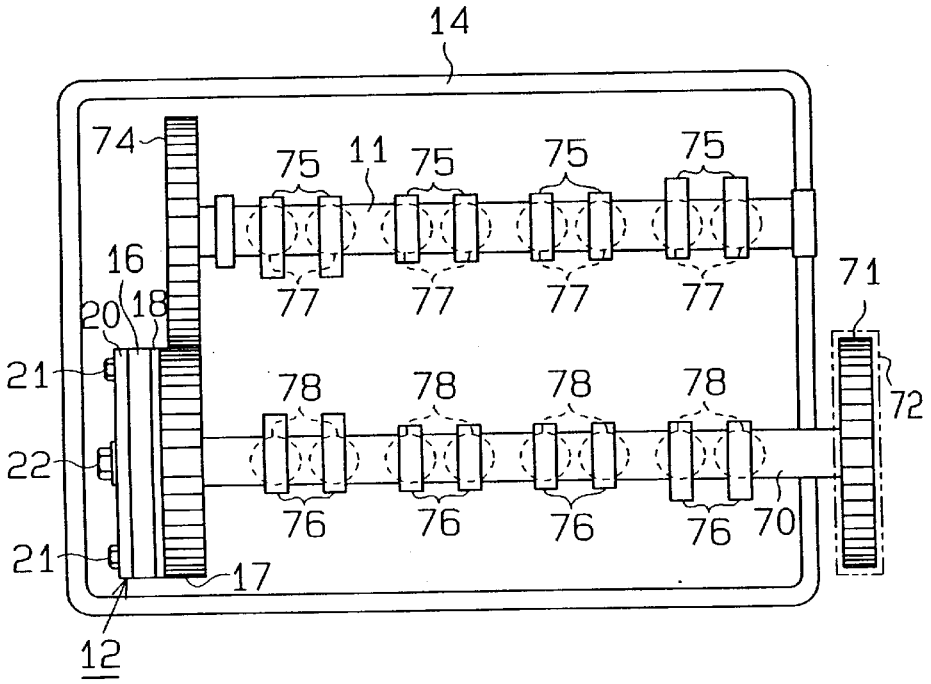
FIG. 9 is a diagrammatic plan view illustrating a VVT according to a further embodiment.
Figure 10:
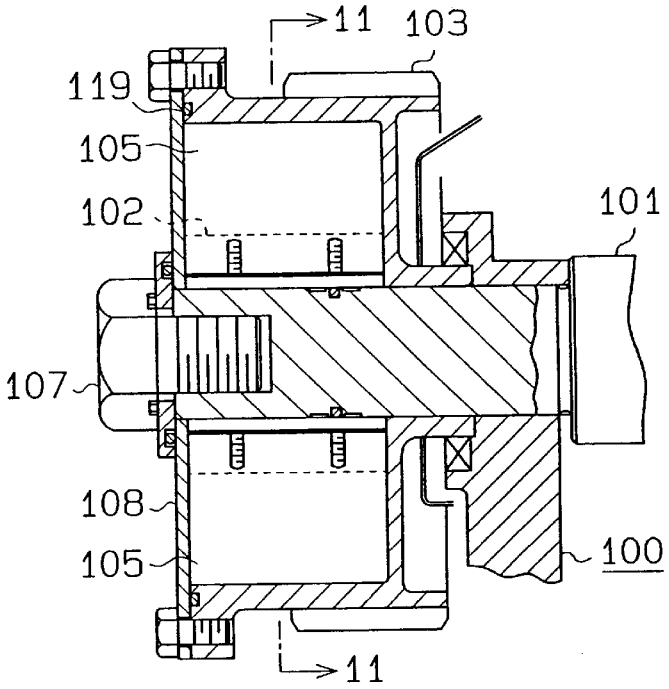
Fig.10 (PRIOR ART)
FIG. 10 is a partial cross-sectional view illustrating a prior art VVT.
Figure 11:
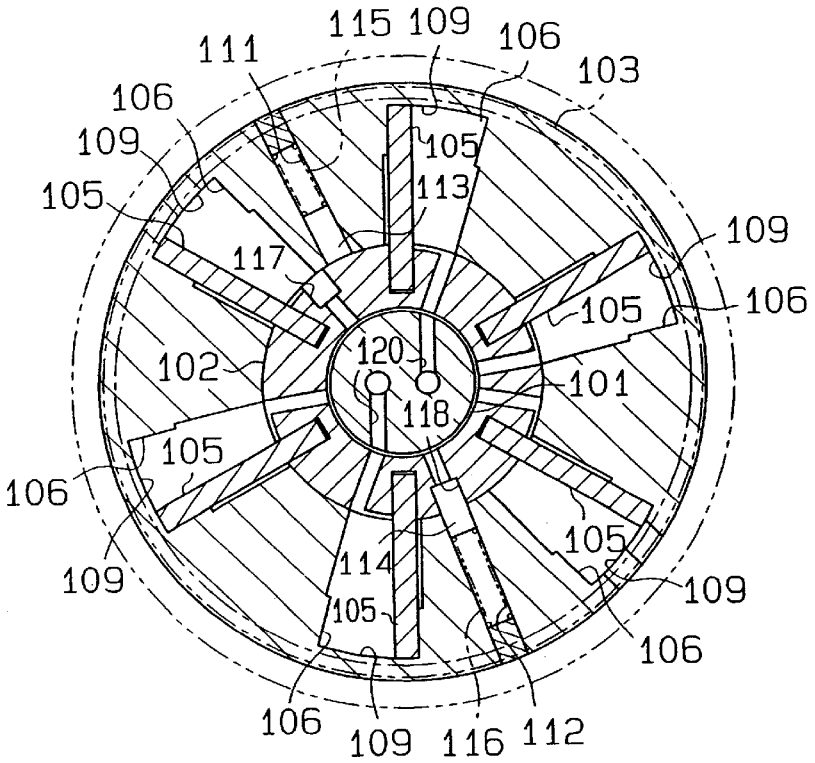
Fig.11 (PRIOR ART)
FIG. 11 is a cross-sectional view taken along line 11—11 of FIG. 10.

In the first embodiment, the VVT 12 is provided on the intake camshaft 11 for changing the valve timing of the intake valves 77. However, as shown in FIG. 9, the VVT 12 may be provided on the exhaust camshaft 70 for changing the valve timing of the intake valves 77.

In the first and second embodiments, the lock mechanism 49 is switched between the locked position and the released position based on the force of the spring 35 and the oil pressure acting on the pressure receiving surfaces 33*c*, 33*d*. However, pressure sensors may be provided in the first and second oil conduit 80, 81 and the lock pin 33 may be moved by an electromagnetic solenoid which is activated based on values detected by the pressure sensors.

In the first embodiment, when the lock mechanism 49 is in the locked position, relative rotation of the housing 16 and the vane body 19 is prohibited and the vane body 19 is fixed at the most retarded position. However, when the mechanism 49 is in the locked position, the vane body 19 is not necessarily fixed at the most retarded position. That is, the position at which the vane body 19 is fixed relative to the housing 16 may be changed by changing the location of the lock hole 34 on the plate 18 for optimizing the valve timing of the intake valves 77 when starting the engine. Also, in the second embodiment, which changes the valve timing of the exhaust valves, the vane body 19 may be fixed other positions than the most advanced position when the lock mechanism 49 is in the locked position.

The number of the vanes 24 may be less than four or more than four. If the number of the vanes 24 is less than that of the first and second embodiments, the construction of the oil conduits 80 and 81 is simplified. If the number of the vanes 24 is larger than that of the first and second embodiments, a greater rotational torque can be applied to the vane body 19.

In the first embodiment, the driven gear 17 of the VVT 12 is operably coupled to the crankshaft by the exhaust camshaft 70. However, the driven gear 17 may be replaced with, for example, a pulley or a sprocket. In this case, the pulley or the sprocket is operably coupled to the crankshaft by a timing belt or a timing chain.

In the first and second embodiments, the valve timing of the intake valves 77 or of the exhaust valves 78 is changed. However, valve timing of both of the intake and exhaust valves may be changed. In this case, the VVT 12 is provided on both of the intake camshaft 11 and the exhaust camshaft 70.

Therefore, the present examples and embodiments are to be considered as illustrative and not restrictive and the invention is not to be limited to the details given herein, but may be modified within the scope and equivalence of the appended claims.

What is claimed is:

1. A variable valve timing mechanism for an internal combustion engine, the engine having a drive shaft, a supply of hydraulic fluid, a driven shaft driven by the drive shaft, and at least one valve driven by the driven shaft, wherein the driven shaft has a torque fluctuation as a result of driving the valve, and wherein the mechanism varies the rotational phase of the driven shaft with respect to the drive shaft to vary the timing of the valve, the mechanism including a first rotor that rotates in synchronism with the drive shaft and a second rotor that rotates in synchronism with the driven shaft, wherein the position of the second rotor with respect to the first rotor is varied by the mechanism to change the rotational phase of the driven shaft with respect to the drive shaft, the mechanism comprising:

an actuating member movable in a first direction and in a second direction, wherein the second direction is opposite to the first direction, and wherein the movement of the actuating member rotates the second rotor with respect to the first rotor to change the rotational phase of the driven shaft with respect to the drive shaft, the actuating member having a first side and a second side, wherein the second side is opposite to the first side;

a first hydraulic chamber located on the first side of the actuating member;

a second hydraulic chamber located on the second side of the actuating member, wherein hydraulic pressure is selectively supplied to one of the first and second hydraulic chambers; and a lock member for locking the second rotor to the first rotor in a predetermined position to fix the rotational phase of the driven shaft with respect to the drive shaft, wherein the lock member is movable between a locked position and an unlocked position, wherein the lock member locks the actuating member with respect to the hydraulic chambers to lock the second rotor with respect to the first rotor in the locked position, and wherein the lock member releases the actuating member to unlock the second rotor with respect to the first rotor in the unlocked position, wherein the lock member remains in the locked position until the pressure of the hydraulic fluid supply increases to a predetermined value to prevent the second rotor from fluctuating rotationally due to the torque fluctuation of the driven shaft.

2. The variable valve timing mechanism according to claim 1, wherein at least one recess is formed in the first rotor, wherein the recess has an abutment wall, wherein the second rotor is located within the first rotor, wherein the actuating member includes a movable vane connected to the second rotor, the vane dividing the recess into the first hydraulic chamber and the second hydraulic chamber, wherein the first and second rotors are locked by the lock member at a position where the vane abuts against the abutment wall.

3. The variable valve timing mechanism according to claim 1, wherein the actuating member moves in the first direction to advance the valve timing and in the second direction to retard the valve timing.

4. The variable valve timing mechanism according to claim 3, wherein the timing of the valve is most retarded when the first side of the vane abuts against the abutment wall.

5. The variable valve timing mechanism according to claim 4, wherein the driven shaft includes an intake camshaft for actuating an intake valve.

6. The variable valve timing mechanism according to claim 1, wherein hydraulic pressure in the second hydraulic chamber moves the vane in the second direction, and rotational fluctuation of the driven shaft moves the vane alternately in the first and second directions, and the lock member is released when a torque applied to the vane from the second hydraulic chamber is at least as great as the fluctuation torque applied to the vane in the first direction.

7. The variable valve timing mechanism according to claim 1 further comprising:

an engagement recess joined to one of the first rotor and the second rotor, the other one of the first rotor and the second rotor having a supporting hole for movably supporting the lock member, wherein the lock member is engaged with the engagement recess in the locked position and is disengaged from the engagement recess in the unlocked position; and an urging means for applying an urging force on the lock member towards the engagement recess.

8. The variable valve timing mechanism according to claim 7, wherein the lock member comprises:

a first pressure receiving surface that is exposed to hydraulic pressure from the first hydraulic chamber, which applies a force to the locking member in a direction that opposes the urging force; and a second pressure receiving surface that is exposed to hydraulic pressure from the second hydraulic chamber, which applies a force to the locking member in a direction that opposes the urging force.

9. The variable valve timing mechanism according to claim 8, wherein the lock member has a large diameter section and a small diameter section, wherein the second pressure receiving surface is located between the large diameter section and the small diameter section.

10. The variable valve timing mechanism according to claim 8, further comprising a second urging means for urging the vane in a direction to advance the rotational phase of the second rotor with respect to the first rotor.

11. The variable valve timing mechanism according to claim 1, wherein the driven shaft includes an exhaust camshaft for actuating an exhaust valve.

12. A variable valve timing mechanism for an internal combustion engine, the engine having a drive shaft, a supply of hydraulic fluid, a driven shaft driven by the drive shaft, and at least one valve driven by the driven shaft, wherein the driven shaft has a torque fluctuation as a result of driving the valve, and wherein the mechanism varies the rotational phase of the driven shaft with respect to the drive shaft to vary the timing of the valve, the mechanism including a first rotor that rotates in synchronism with the drive shaft and a second rotor that rotates in synchronism with the driven shaft, wherein the position of the second rotor with respect to the first rotor is varied by the mechanism to change the rotational phase of the driven shaft with respect to the drive shaft, the mechanism comprising:

an actuating member movable in a first direction and in a second direction, wherein the second direction is opposite to the first direction, wherein the actuating member moves in the first direction to advance the valve timing and in the second direction to retard the valve timing, and wherein the movement of the actuating member rotates the second rotor with respect to the first rotor to change the rotational phase of the driven shaft with respect to the drive shaft, the actuating member having a first side and a second side, wherein the second side is opposite to the first side;

a first hydraulic chamber located on the first side of the actuating member;

a second hydraulic chamber located on the second side of the actuating member, wherein hydraulic pressure is selectively supplied to one of the first and second hydraulic chambers; and a lock member for locking the second rotor to the first rotor in a predetermined position to fix the rotational phase of the driven shaft with respect to the drive shaft, wherein the lock member is movable between a locked position and an unlocked position, wherein the lock member locks the actuating member with respect to the hydraulic chambers to lock the second rotor with respect to the first rotor in the locked position, wherein hydraulic pressure in the second hydraulic pressure chamber moves the actuating member in the second direction, and rotational fluctuation of the driven shaft moves the actuating member alternately in the first and second directions, and the lock member is released when force applied to the actuating member from the second hydraulic chamber is greater than the fluctuation force applied to the actuating member in the first direction.

13. The variable valve timing mechanism according to claim 12 further comprising:

an engagement recess joined to one of the first rotor and the second rotor, the other one of the first rotor and the second rotor having a supporting hole for movably supporting the lock member, wherein the lock member is engaged with the engagement recess in the locked position and is disengaged from the engagement recess in the unlocked position; and an urging means for applying an urging force on the lock member towards the engagement recess.

14. The variable valve timing mechanism according to claim 13, wherein the lock member comprises:

a first pressure receiving surface that is exposed to hydraulic pressure from the first hydraulic chamber, which applies a force to the locking member in a direction that opposes the urging force; and a retarding pressure receiving surface that is exposed to hydraulic pressure from the retarding hydraulic chamber, which applies a force to the locking member in a direction that opposes the urging force.

15. A variable valve timing mechanism for an internal combustion engine, the engine having a drive shaft, a supply of hydraulic fluid, a camshaft driven by the drive shaft, and a set of valves driven by the camshaft, wherein the camshaft has a torque fluctuation as a result of driving the valves, and wherein the mechanism varies the rotational phase of the camshaft with respect to the drive shaft to vary the timing of the valves, the mechanism including a drive rotor that rotates in synchronism with the drive shaft and a driven rotor that rotates in synchronism with the driven shaft, wherein the position of the driven rotor with respect to the drive rotor is varied by the mechanism to change the rotational phase of the camshaft with respect to the drive shaft, the mechanism comprising:

an actuating member movable in an advancing direction and in a retarding direction, wherein the retarding direction is opposite to the advancing direction, wherein the actuating member moves in the advancing direction to advance the valve timing and in the retarding direction to retard the valve timing, and wherein the movement of the actuating member rotates the driven rotor with respect to the drive rotor to change the rotational phase of the camshaft with respect to the drive shaft, the actuating member having an advancing side and a retarding side, wherein the retarding side is opposite to the advancing side;

an advancing hydraulic chamber located on the advancing side of the actuating member;

a retarding hydraulic chamber located on the retarding side of the actuating member, wherein hydraulic pressure is selectively supplied to one of the advancing and retarding hydraulic chambers; and a lock member for locking the driven rotor to the drive rotor in a predetermined position to fix the rotational phase of the camshaft with respect to the drive shaft, wherein the lock member is movable between a locked position and an unlocked position, wherein the lock member, when in the locked position, locks the actuating member with respect to the advancing and retarding hydraulic chambers to lock the driven rotor with respect to the drive rotor, and wherein the lock member, when in the unlocked position, releases the actuating member to unlock the driven rotor with respect to the drive rotor, and wherein the lock member remains in the locked position until the pressure of the hydraulic fluid supply increases to a predetermined value to prevent the driven rotor from fluctuating rotationally due to the torque fluctuation of the camshaft.

16. The variable valve timing mechanism according to claim 15, wherein the lock member is urged towards the locked position by a spring, and wherein a portion of the lock member is exposed to the hydraulic fluid supply, and wherein the size of the lock member and the force of the spring are selected such that the lock member is hydraulically pushed to the unlocked position when the pressure of the hydraulic fluid in the advancing hydraulic chamber is great enough to produce a torque on the actuating member that substantially fully counters an opposite torque on the actuating member resulting from the torque fluctuation.

* * * * *

UNITED STATES PATENT AND TRADEMARK OFFICE

CERTIFICATE OF CORRECTION

PATENT NO. : 5,816,204

DATED : October 6, 1998

INVENTOR(S) : MORIYA et al.

It is certified that error appears in the above-identified patent and that said Letters Patent is hereby corrected as shown below:

On the title page,

Please add:

-- [30] Foreign Application Priority Data

November 29, 1996 [JP] Japan 8-319824

April 24, 1997 [JP] Japan 9-107845 --.

Signed and Sealed this

Eighteenth Day of May, 1999

*Attest:*

*Attesting Officer*

Q. TODD DICKINSON

*Acting Commissioner of Patents and Trademarks*